US007846034B1

(12) United States Patent
Lightfoot

(10) Patent No.: US 7,846,034 B1
(45) Date of Patent: Dec. 7, 2010

(54) GOLF AIM ASSISTING ASSEMBLY

(76) Inventor: Ian Lightfoot, 490 Nelson Avenue, Apartment #501, Burlington, ON (CA) L7S 1X3

( * ) Notice: Subject to any disclaimer, the term of this patent is extended or adjusted under 35 U.S.C. 154(b) by 0 days.

(21) Appl. No.: 12/398,614

(22) Filed: Mar. 5, 2009

(51) Int. Cl.
*A63B 69/36* (2006.01)

(52) U.S. Cl. ..... 473/257; 473/387

(58) Field of Classification Search ..... 473/386–403, 473/257, 278

See application file for complete search history.

(56) References Cited

U.S. PATENT DOCUMENTS

| | | | | |
|---|---|---|---|---|
| 1,643,113 | A | 9/1927 | Clark | |
| 1,761,532 | A * | 6/1930 | Morris | 473/218 |
| 2,152,381 | A * | 3/1939 | Harpster | 473/265 |
| 2,165,479 | A * | 7/1939 | Hallberg | 473/257 |
| 3,347,551 | A * | 10/1967 | Dreyfus | 473/257 |
| 3,883,144 | A * | 5/1975 | Lazow | 473/218 |
| 4,181,311 | A * | 1/1980 | Lawlor | 473/257 |
| 5,372,362 | A | 12/1994 | Barker | |
| 5,437,448 | A * | 8/1995 | Balson | 473/257 |
| D391,611 | S | 3/1998 | Brayford | |
| 5,755,629 | A | 5/1998 | Blomgren | |
| 6,267,235 | B1 * | 7/2001 | Matias et al. | 206/315.1 |
| 6,514,151 | B2 * | 2/2003 | Delaplane | 473/268 |
| 7,008,336 | B2 | 3/2006 | Bores | |
| 2007/0219022 | A1 | 9/2007 | Lee | |

* cited by examiner

*Primary Examiner*—Nini Legesse

(57) ABSTRACT

A golf stroke aim assisting assembly includes a golf tee that has a top end, a bottom end and a peripheral surface extending between the top and bottom ends. The bottom end is pointed and the top end is concave to support a golf ball. A plate has a top side, a bottom side and a perimeter edge. The plate has an aperture therein extending into the top side and outwardly of the bottom side. The peripheral edge includes a pair of lateral edges tapering toward each other and coming to a point. The bottom end of the tee is extended through the aperture and is extendable into a ground surface. The point is directable toward an area in which a golf ball is to be struck to assist a person in aiming while striking a golf ball off of the top end.

8 Claims, 4 Drawing Sheets

GOLF AIM ASSISTING ASSEMBLY

BACKGROUND OF THE DISCLOSURE

Field of the Disclosure

The disclosure relates to golf aim helping devices and more particularly pertains to a new golf aim helping device for assisting a person to determine correct body alignment with respect to a golf ball to determine an outcome of ball flight.

SUMMARY OF THE DISCLOSURE

An embodiment of the disclosure meets the needs presented above by generally comprising a golf tee that has a top end, a bottom end and a peripheral surface extending between the top and bottom ends. The bottom end is pointed and the top end is concave to support a golf ball. A plate has a top side, a bottom side and a perimeter edge. The plate has an aperture therein extending into the top side and outwardly of the bottom side. The peripheral edge includes a pair of lateral edges tapering toward each other and coming to a point. The bottom end of the tee is extended through the aperture and is extendable into a ground surface. The point is directable toward an area in which a golf ball is to be struck to assist a person in aiming while striking a golf ball off of the top end.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
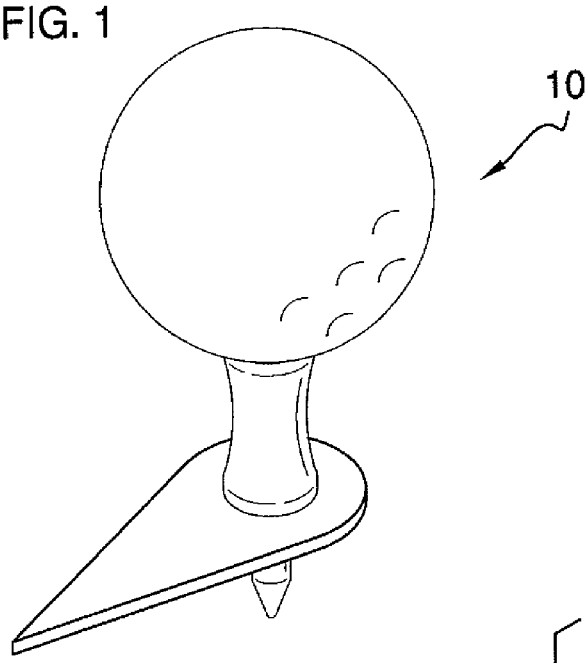
FIG. 1 is an in-use top perspective view of a golf stroke aim assisting assembly according to an embodiment of the disclosure.
Figure 2:
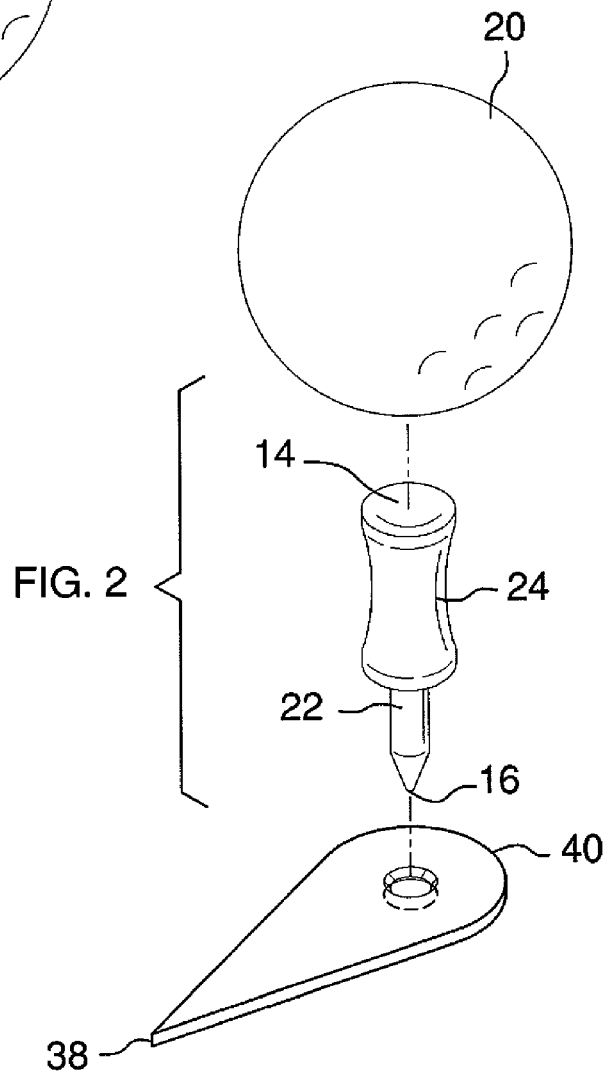
FIG. 2 is a perspective expanded view of an embodiment of the disclosure.
Figure 3:
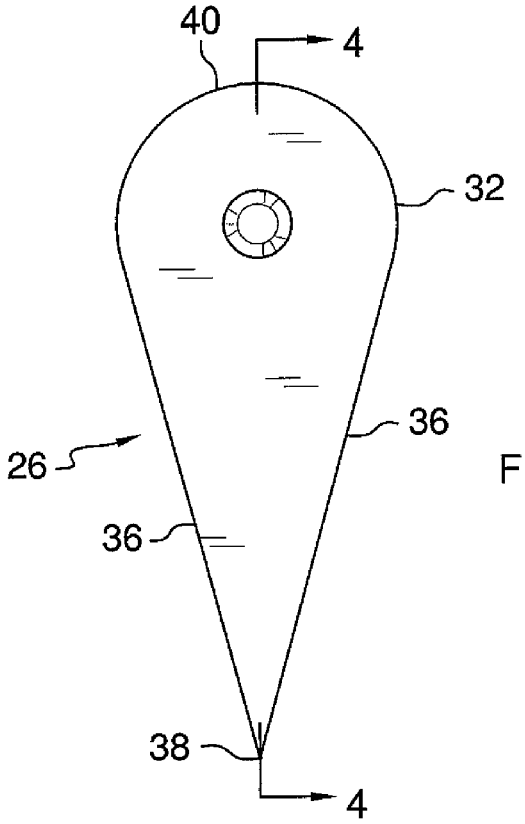
FIG. 3 is a top view of an embodiment of the disclosure.

With reference now to the drawings, and in particular to FIGS. 1 through 7 thereof, a new golf aim helping device embodying the principles and concepts of an embodiment of the disclosure and generally designated by the reference numeral 10 will be described.

As best illustrated in FIGS. 1 through 7, the golf stroke aim assisting assembly 10 generally comprises a golf tee 12 that has a top end 14, a bottom end 16 and a peripheral surface 18 extending between the top 14 and bottom 16 ends. The bottom end 16 is pointed and the top end 14 is concave to support a golf ball 20. The golf tee 12 may be comprised of either a plastic or wood material. The peripheral surface 18 includes a narrow section 22 and a wide section 24. The narrow section 22 abuts the bottom end 16 and the wide section 24 abuts the top end 14. The wide section 24 extends downwardly from the top end 14 a distance equal to at least 0.50 inches and may be at least 1.50 inches. The wide section 24 is no wider than a diameter of top end 14 at a juncture of the top end 14 and the peripheral surface 18.

Figure 4:
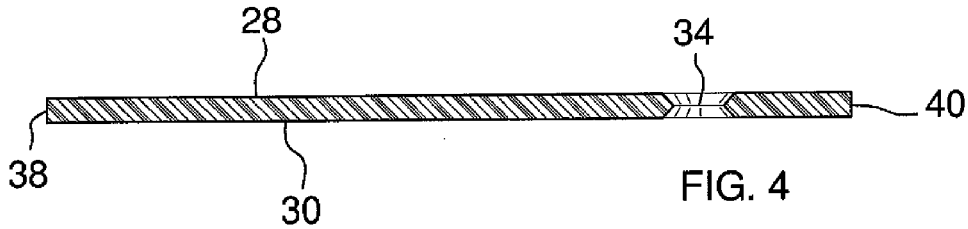
FIG. 4 is a cross-sectional view taken along line 4-4 of FIG. 3 of an embodiment of the disclosure.
Figure 5:
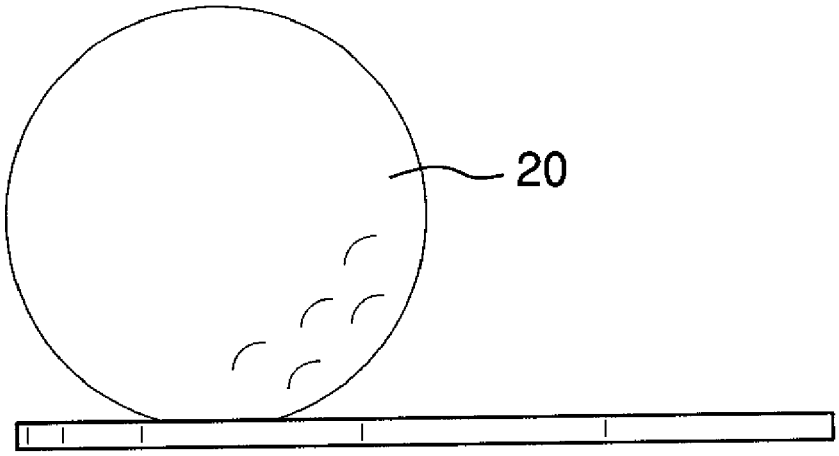
FIG. 5 is a side in-use view of an embodiment of the disclosure.
Figure 6:
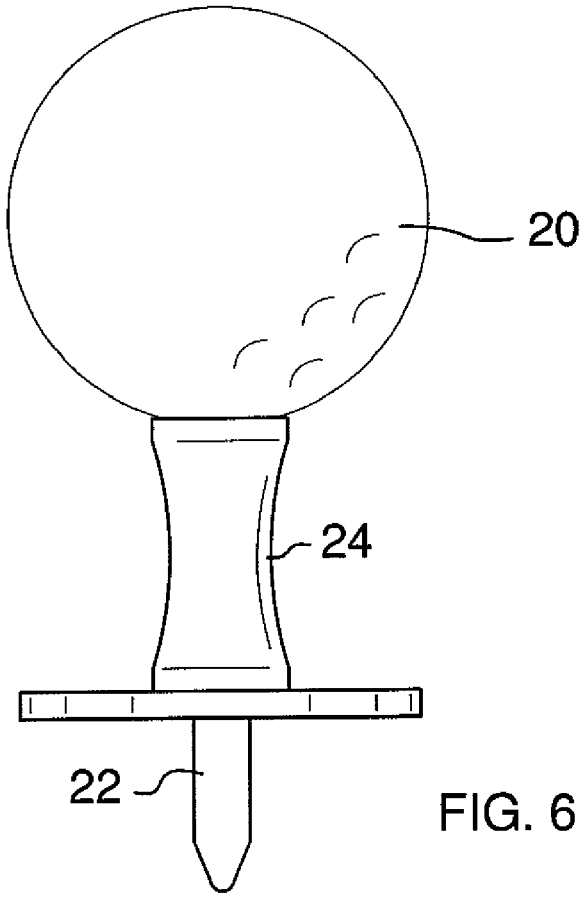
FIG. 6 is an end view of an embodiment of the disclosure.

A plate 26 has a top side 28, a bottom side 30 and a perimeter edge 32. The plate 26 has an aperture 34 therein extending into the top side 28 and outwardly of the bottom side 30. The aperture 34 may be tapered inward from both the top 28 and bottom 30 sides as shown in FIG. 4. This will allow the plate 26 to be used without a tee as shown in FIG. 5. The aperture 34 has a diameter smaller than a width of the wide section 24 to prevent the wide section 24 from is extended through the aperture 34.

Figure 7:
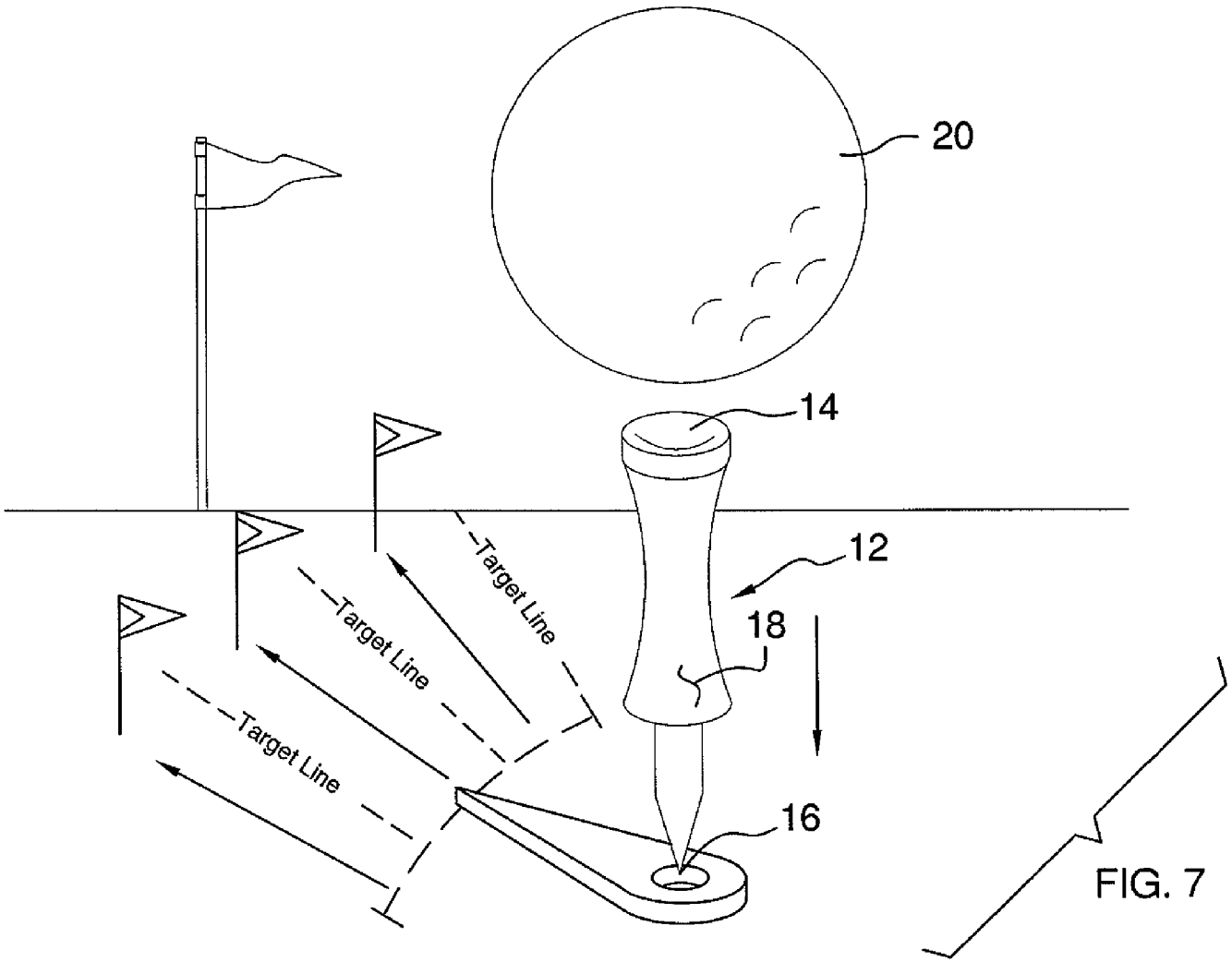
FIG. 7 is a rear perspective in-use view of an embodiment of the disclosure.

The peripheral edge 32 includes a pair of lateral edges 36 tapering toward each other and coming to a point 38. The bottom end 16 of the tee is extended through the aperture 34 and is extendable into a ground surface. The point 38 is directable toward an area in which a golf ball 20 is to be struck to assist a person in aiming while striking a golf ball off of the top end 14. As shown in FIG. 7, the user of the assembly 10 can simply aim the point in the direction of desired ball flight 20. When the user goes to strike the golf ball 20, the user may then more easily align their body with the point.

The plate 26 includes a distal edge 40 positioned opposite of the point. A distance from the point 38 to the distal edge 40 is between 1.50 inches and 3.0 inches. A distance from the aperture 34 to the distal edge 40 is less than ¾ inch and the distal edge 40 is convexly arcuate.

In use, the golf tee 12 is used in a conventional manner to support a golf ball 20 so that it may be struck with a golf club. However, the tee 12 is extended through the plate 26 to allow a person to aim the point 38 in the direction ball flight is desired. The wide section 24 ensures that the plate 26 will not interfere with the golf club striking the ball 20.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A golf stroke aiming assembly comprising:

a golf tee having a top end, a bottom end and a peripheral surface extending between said top and bottom ends, said bottom end being pointed, said top end being concave to support a golf ball;

a plate having a top side, a bottom side and a perimeter edge, said plate having an aperture therein extending into said top side and outwardly of said bottom side, said peripheral edge including a pair of lateral edges tapering toward each other and coming to a point, said bottom end of said tee being extended through said aperture and being extendable into a ground surface, said point being directable toward an area in which a golf ball is to be struck to assist a person in aiming while striking a golf ball off of said top end; and said peripheral surface including a narrow section and a wide section, said narrow section abutting said bottom end and said wide section abutting said top end, said aperture having a diameter smaller than a width of said wide section to prevent said wide section from being extended through said aperture, said wide section extending downwardly from said top end a distance equal to at least 0.50 inches, said wide section being demarcated from said narrow section by an outwardly extending shoulder defining a lower end of said wide section, said height of said wide section inhibiting the striking of said plate by golf club when a golf ball is struck off of said tee.

2. The assembly according to claim 1, wherein said plate includes a distal edge positioned opposite of said point, a distance from said point to said distal edge being between 1.50 inches and 3.0 inches.

3. The assembly according to claim 2, wherein a distance from said aperture to said distal edge being less than ¾ inch.

4. The assembly according to claim 1, wherein said plate includes a distal edge positioned opposite of said point, a distance from said aperture to said distal edge being less than ¾ inch.

5. A golf stroke aiming assembly comprising:

a golf tee having a top end, a bottom end and a peripheral surface extending between said top and bottom ends, said bottom end being pointed, said top end being concave to support a golf ball, said peripheral surface including a narrow section and a wide section, said narrow section abutting said bottom end and said wide section abutting said top end, said wide section extending downwardly from said top end a distance equal to at least 0.50 inches;

a plate having a top side, a bottom side and a perimeter edge, said plate having an aperture therein extending into said top side and outwardly of said bottom side, said peripheral edge including a pair of lateral edges tapering toward each other and coming to a point, said bottom end of said tee being extended through said aperture and being extendable into a ground surface, said point being directable toward an area in which a golf ball is to be struck to assist a person in aiming while striking a golf ball off of said top end, said plate including a distal edge positioned opposite of said point, a distance from said point to said distal edge being between 1.50 inches and 3.0 inches, a distance from said aperture to said distal edge being less than ¾ inch, said aperture having a diameter smaller than a width of said wide section to prevent said wide section from being extended through said aperture; and said wide section being demarcated from said narrow section by an outwardly extending shoulder defining a lower end of said wide section, said height of said wide section inhibiting the striking of said plate by golf club.

6. A golf stroke aiming assembly comprising:

a golf tee having a top end, a bottom end and a peripheral surface extending between said top and bottom ends, said bottom end being pointed, said top end being concave to support a golf ball; and a plate having a top side, a bottom side and a perimeter edge, said plate having an aperture therein extending into said top side and outwardly of said bottom side, said peripheral edge including a pair of lateral edges tapering toward each other and coming to a point, said bottom end of said tee being extended through said aperture and being extendable into a ground surface, said point being directable toward an area in which a golf ball is to be struck to assist a person in aiming while striking a golf ball off of said top end, said plate includes a distal edge positioned opposite of said point, a distance from said point to said distal edge being between 1.50 inches and 3.0 inches, and wherein a distance from said aperture to said distal edge being less than ¾ inch.

7. The assembly according to claim 6, wherein said wide section extends downwardly from said top end a distance equal to at least 0.50 inches, said wide section being demarcated from said narrow section by an outwardly extending shoulder defining a lower end of said wide section, said height of said wide section inhibiting the striking of said plate by golf club.

8. The assembly according to claim 6, wherein said peripheral surface includes a narrow section and a wide section, said narrow section abutting said bottom end and said wide section abutting said top end, said aperture having a diameter smaller than a width of said wide section to prevent said wide section from being extended through said aperture.

* * * * *